United States Patent [19]

Herberholz et al.

[11] 4,373,755

[45] Feb. 15, 1983

[54] LIFTING DEVICE FOR THE TRANSPORTATION OF FLASKS

[76] Inventors: Klaus Herberholz, Taunusstrasse 31, 6457 Maintal 2; Peter Schmidt, Huhnerberg 1, 6466 Grundau, both of Fed. Rep. of Germany

[21] Appl. No.: 201,196

[22] Filed: Oct. 27, 1980

[30] Foreign Application Priority Data

Oct. 27, 1979 [DE] Fed. Rep. of Germany ..... 2943523

[51] Int. Cl.[3] ..... B66C 1/10

[52] U.S. Cl. ..... 294/67 R; 294/81 R

[58] Field of Search ..... 294/67 R, 67 AA, 67 B, 294/67 BB, 67 BC, 67 D, 67 DA, 67 DB, 67 DC, 73, 78 A, 81 R, 81 SF, 86 A, 86 LS, 104

[56] References Cited

U.S. PATENT DOCUMENTS

| | | | |
|---|---|---|---|
| 3,146,016 | 8/1964 | Daymon | 294/81 R X |
| 3,304,115 | 2/1967 | Brooks et al. | 294/81 R |
| 3,750,814 | 8/1973 | Allegri et al. | 294/67 DA X |

FOREIGN PATENT DOCUMENTS

| | | | |
|---|---|---|---|
| 1058551 | 3/1954 | France | 294/81 R |
| 1113322 | 3/1956 | France | 294/81 R |
| 1483879 | 6/1967 | France | 294/67 R |
| 1395084 | 5/1975 | United Kingdom | 294/81 R |

*Primary Examiner*—Johnny D. Cherry

*Attorney, Agent, or Firm*—Cushman, Darby & Cushman

[57] ABSTRACT

Previously known lifting devices for transportation of flasks having lateral trunnions at each end and containing radioactive material were not employable for different sizes of large flasks without considerable adjustments and structural alterations. This invention avoids the necessity for such changes and alterations with a lifting device which consists of a crane hook attachment structure on top of a torsion body having cross pieces on its opposite ends from which hang lug side arms for detachable engagement with the trunnions of the flask. One cross piece is rigidly fixed on the torsion body, while the other cross piece is suspended for tilting on a horizontal axis on the torsion body. The lug side arms are suspended from laterally swingable end portions of the cross pieces and are secured to the cross pieces swivelingly around vertical pivots.

9 Claims, 7 Drawing Figures

LIFTING DEVICE FOR THE TRANSPORTATION OF FLASKS

BACKGROUND OF THE INVENTION

The object of the invention is a lifting device for transportation in a horizontal position of flasks having a pair of lateral trunnions at either end, particularly flasks for the transportation of radioactive materials in industrial nuclear plants. The device consists of a crane hook attachment structure on top of a torsion body having crossbars on its ends with lug side arms for detachable engagement with the trunnions of the flask hanging from the ends of the crossbars.

Lifting devices to handle flasks are known to be employed for the removal of nuclear fuels from nuclear power plants, particularly flasks for the transportation of fuel elements, in a horizontal position.

To this end lifting devices are used which are constructed specially for one or two types of flasks of similar design. These lifting devices consist essentially of a crane hook attachment structure on top of a torsion body which has crossbars provided with lug side arms to engage the trunnions of the flask. These lifting devices are essentially characterized by having four lug side arms which are spreadable by means of hydraulic pumps in order to attach them to the flask trunnions, generally numbering four.

With these lifting devices flasks with different trunnion distances can indeed be handled, but before a different flask can be handled, mechanical adjustments must be made in the device. Likewise, there are flasks of different geometries, weights and specific shock absorber design which cannot be handled without an adjustment in the lifting device because the position of the centre of gravity of these devices cannot be adjusted continuously and handling of flasks can therefore only take place by exchanging the lug side arms of the device.

Therefore it is in many cases necessary to remove and replace the heavy lug side arms with the main crane employed in order to attain a correct attachment of the lug side arms to the flask.

In special cases the horizontal transportation of flasks is carried out by means of shackles and cables, which, however, has the disadvantage that it does not meet the latest safety standards.

Thus there is described in German OS No. 2528532 a device for securing loads on cranes with a redundantly arranged hanging cable, which, however, no longer meets present safety requirements.

Furthermore, there are lifting devices in use whose lug side arm elements indeed have two degrees of freedom of movement, but where the second one of these is only for the purpose of attaching the brackets to the flask trunnions.

It is likewise known (German OS No. 2,637,843) to design lifting devices with additional equipment for security against dropping the flask. In so doing a very expensive construction is involved, which must be provided in addition to the lifting device and which only secures the flask in a vertical position. However, there is no security for transportation of the flask in its horizontal position.

German OS No. 2,364,928 describes how all kinds of loads can be handled in a specified inclined position. Lifting devices of this type, however, on account of their size, cannot be operated in the airlocks of an industrial nuclear plant. Furthermore, with these types of lifting devices, no precautions are provided to guarantee the unconditionally required stability in the event of a lug side arm.

Therefore, it was the purpose of the invention to develop a lifting device for the transportation in a horizontal position of flasks provided with lateral trunnions at their ends, particularly transportation of flasks containing radioactive materials. Such a device consists essentially of a crane hook attachment structure on top of a torsion body having crossbars at its ends with lug side arms to be fitted to the trunnions of the flask hanging from the ends of the crossbars. This lifting device is usable without modification or adjustment for flasks having different centres of gravity; it does not give rise to a dropping risk in case of failure of a lug side arm; and, furthermore, guarantees ease of operation in the narrow airlocks of industrial nuclear plants.

SUMMARY OF THE INVENTION

This problem was solved according to the invention by having an adjustable connection between the crane hook attachment structure and the torsion body; one crossbar being fixed securely to the torsion body; the other crossbar being suspended for tilting on a horizontal axis on the torsion body; the lug side arms hanging from laterally swingable end portions of the crossbars and secured thereto hinged about a vertical axis; and limit stops for the tilting crossbar.

With the lifting device of this invention, different types of flasks can be handled, via the continuously adjustable lug side arms, and the individual inclination of a flask caused by the position of its centre of gravity, can be compensated for by way of a continuously adjustable setting of the crane hook supporting structure.

Redundancy in the system, which, in case of human error or failure of a lug side arm, is required in order to prevent dropping of a flask, and this is achieved by a specially constructed torsion body having cushioning members which are able to safely take up the dynamic forces ensuing.

DETAILED DESCRIPTION OF THE INVENTION

Figure 1:
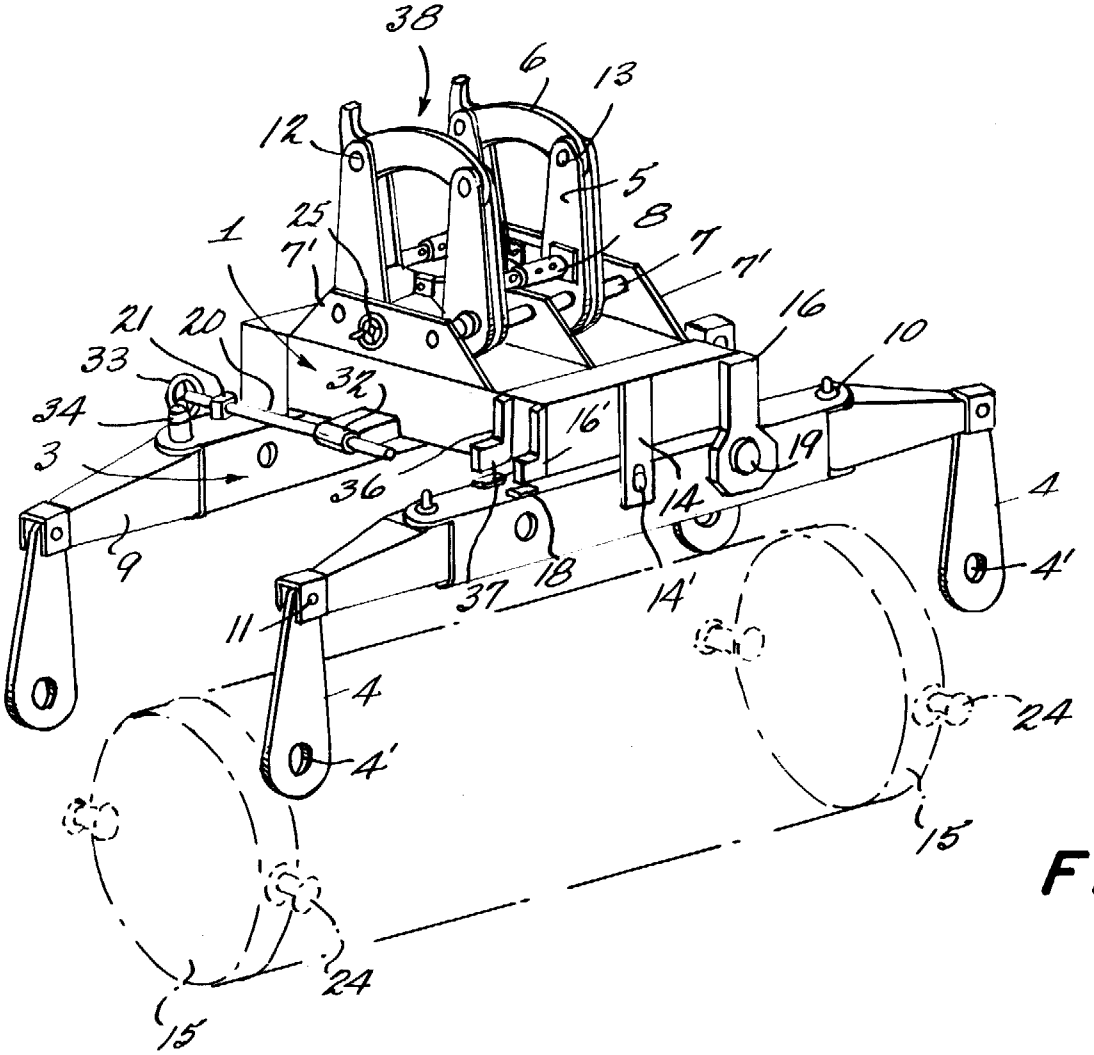
FIG. 1 is a schematic perspective view of one form of lifting device of the invention.

Referring more specifically to FIG. 1 of the drawings the lifting device of the invention comprises a crane hook attachment structure 38 on torsion body 1 having cross pieces 2 and 3 fastened to the ends thereof.

The torsion body 1 is constructed, for example, in the shape of a flat box which is provided internally with stiffening compartment sheets (not shown). The body 1 is normally a welded construction of sheet steel which has on one end fixedly welded therebeneath a cross piece 3 and on the opposite end suspended therebeneath for tilting on a horizontal axis a cross piece 2. The fixed cross piece 3 and the tilting cross piece 2 are each constructed as a welded hollow profile made of connecting top, bottom and side sheets or plates (FIG. 1).

Figure 4:
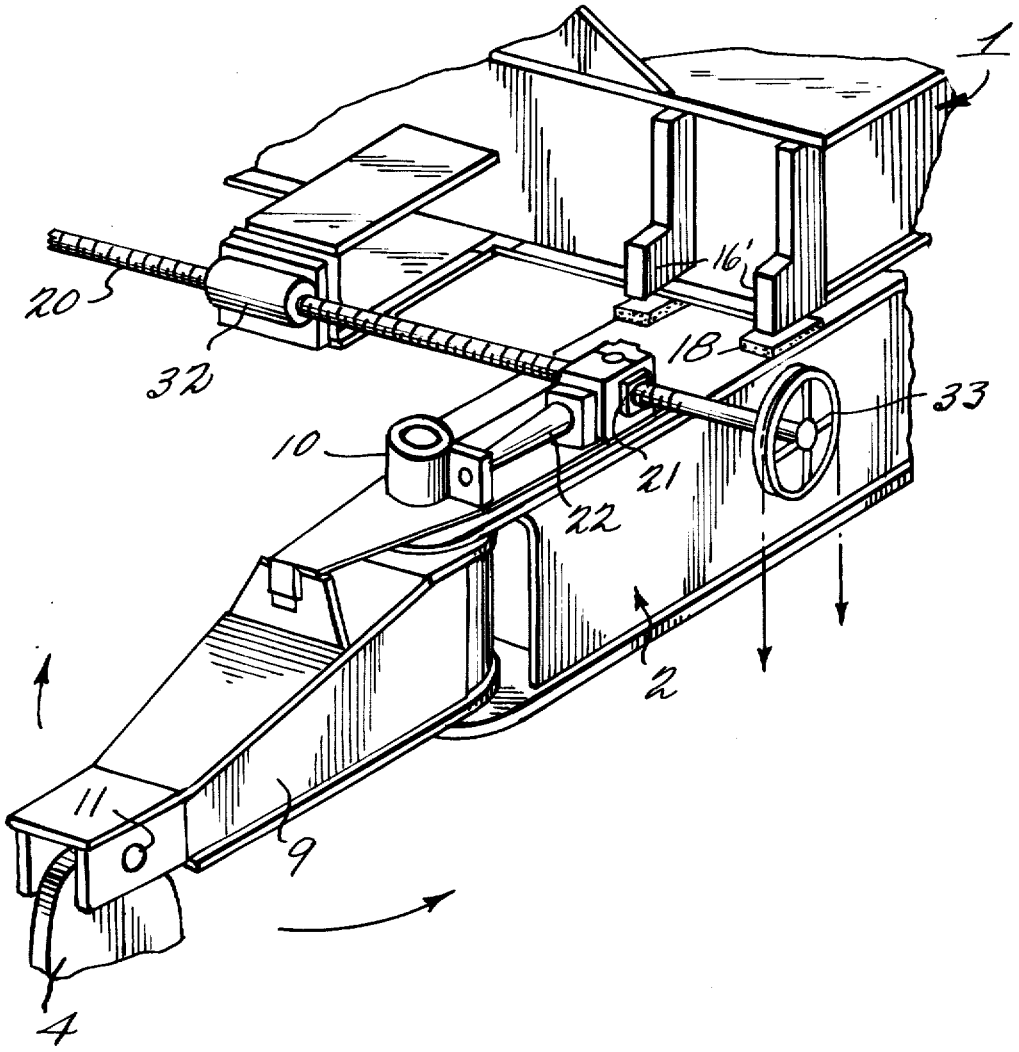
FIG. 4 is an enlarged fragmentary view of the swingable end portion construction of the lug side arms shown in FIG. 1.

On the ends of each of the two cross pieces 2 and 3 is a boom or rocker arm 9 which is swingable sideways or laterally in a given degree about a vertical pivot in a rocker bearing 10 (FIG. 4).

Figure 3:
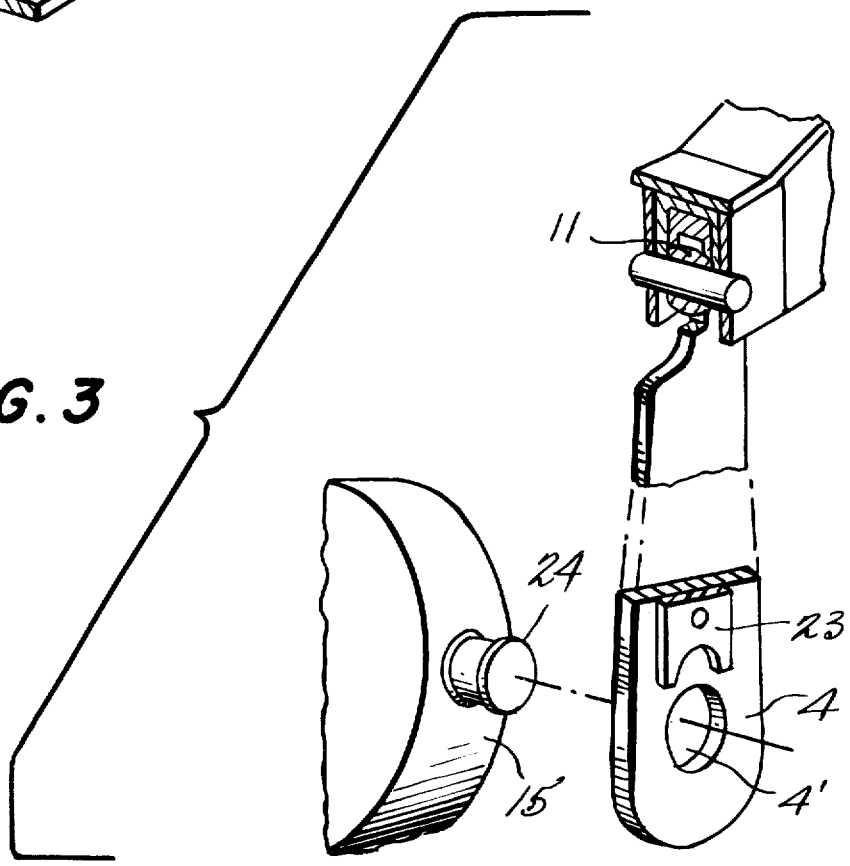
FIG. 3 is an enlarged fragmentary view, with parts broken away, showing the lug side arm construction of the lifting device shown in FIG. 1.

At the outer ends of these arms 9, the lug side arms 4 are suspended for free swinging movement by means of swing bearings 11 (FIG. 3). The lug side arms 4 in their lower ends are provided with holes 4' to fit the flask trunnions 24. The lug side arms have security latches 23. The security latches have sliding bolts which guarantee a snug fit with the flask trunnions 24 and a safe handling of the flask 15 (FIG. 3). The rocker bearings 10 of each pair of swinging arms or booms 9 are connected, via travelling nuts 21, to the ends of a jackscrew 20 having two sets of threads of opposite direction on opposite sides of a central bearing 32 fastened on the torsion body 1.

Rotation of the screw by a hand or chain-operated wheel 33, swings the arms 9 in opposite directions (FIG. 4).

Figure 5:
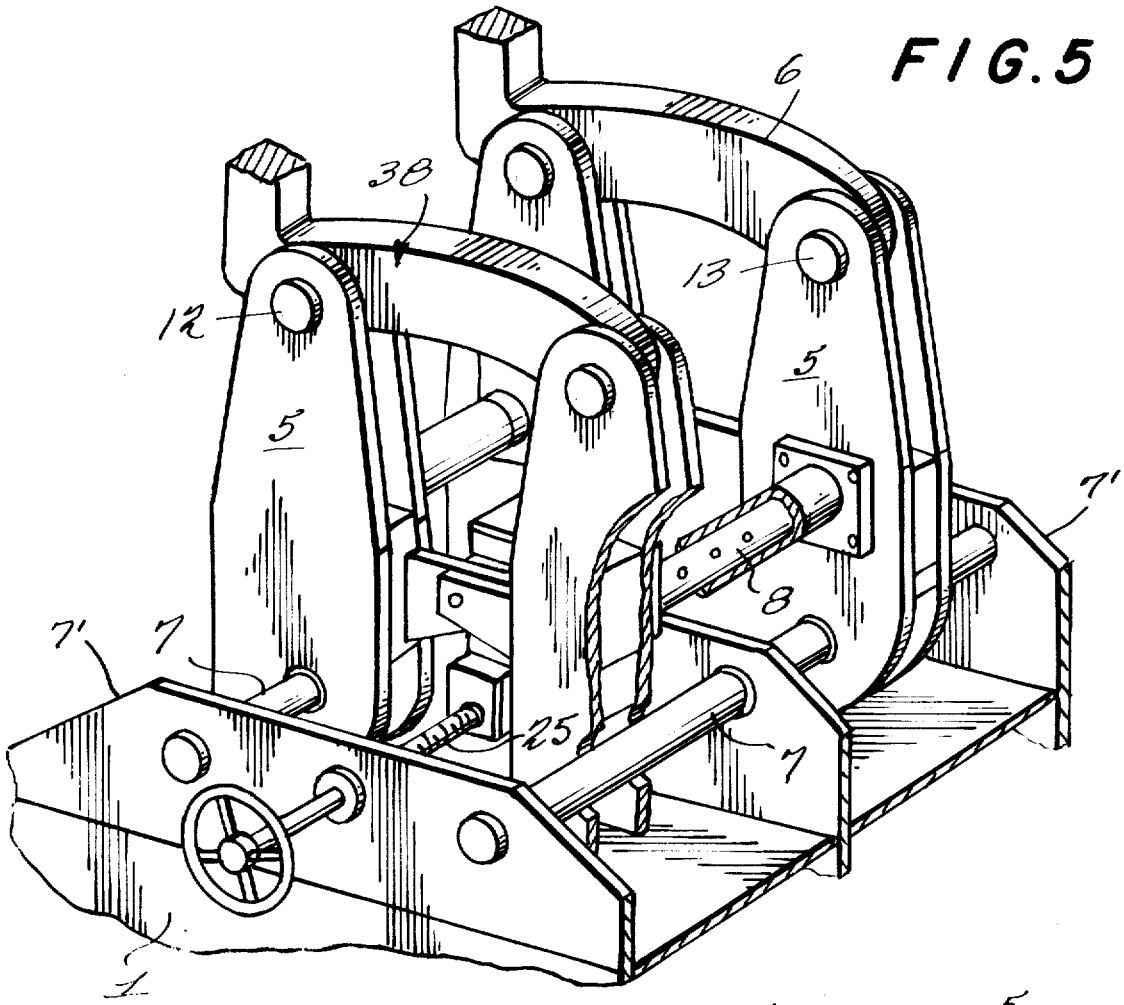
FIG. 5 is an enlarged fragmentary view of the crane hook attachment structure shown in FIG. 1.
Figure 6:
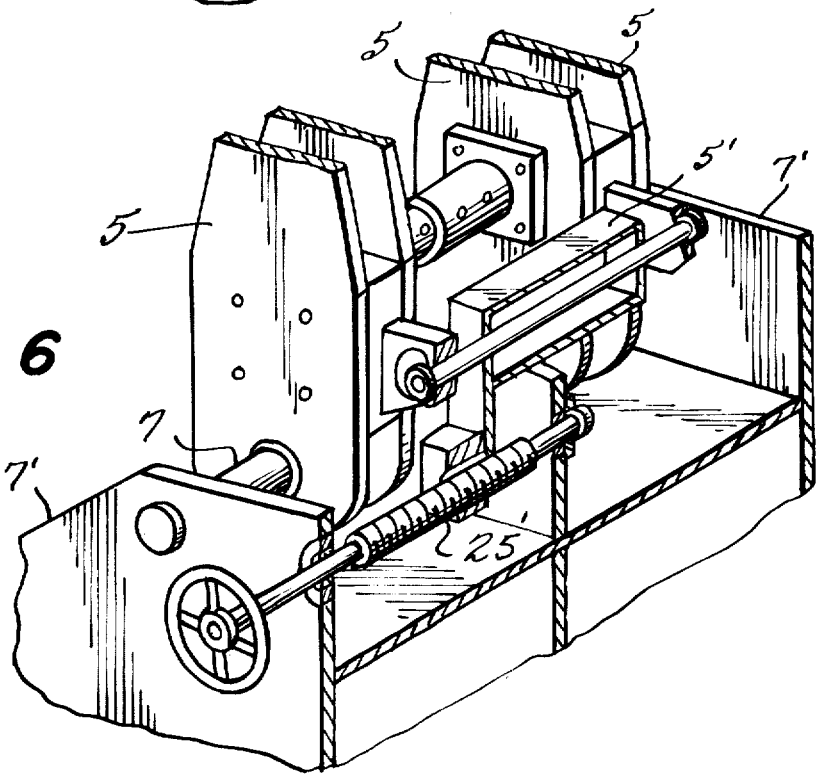
FIG. 6 is an enlarged fragmentary view, with parts broken away, showing details of the crane hook attachment structure shown in FIG. 5.

The crane hook attachment structure 38 (FIG. 5) is fastened to a pair of parallel rods 7 extending transversely through up-standing web plates on the box shaped body 1. This crane hook attachment structure 38 consists of four pairs of upright carrier plates 5 pivotally mounted at their lower ends on the rods 7. The upper ends of corresponding pairs of the plates 5 are connected by curved metal links 6 with pivot pins 12 at one end and detachable locking devices or pins 13 at the other. Adjustable-length spacer tubes 8 are connected to and between pairs of the carrier plates 5 (FIG. 5). The carrier plates 5 can be moved longitudinally along the supporting rods 7 by a jackscrew 25 journaled in the upstanding webs 7' of the body 1 and having a travelling nut 25 thereon connected to the plates 5 by a mechanism 5' which permits the plates to rock on the rods 7 (FIG. 6). The suspended tilting cross piece 2 is supported on the torsion body 1 by a supporting pin 14' secured to and between the lower ends of a pair of arms 14, depending from the body 1 with the pin extending through a longitudinally elongated slot in the arms 14.

Figure 2:
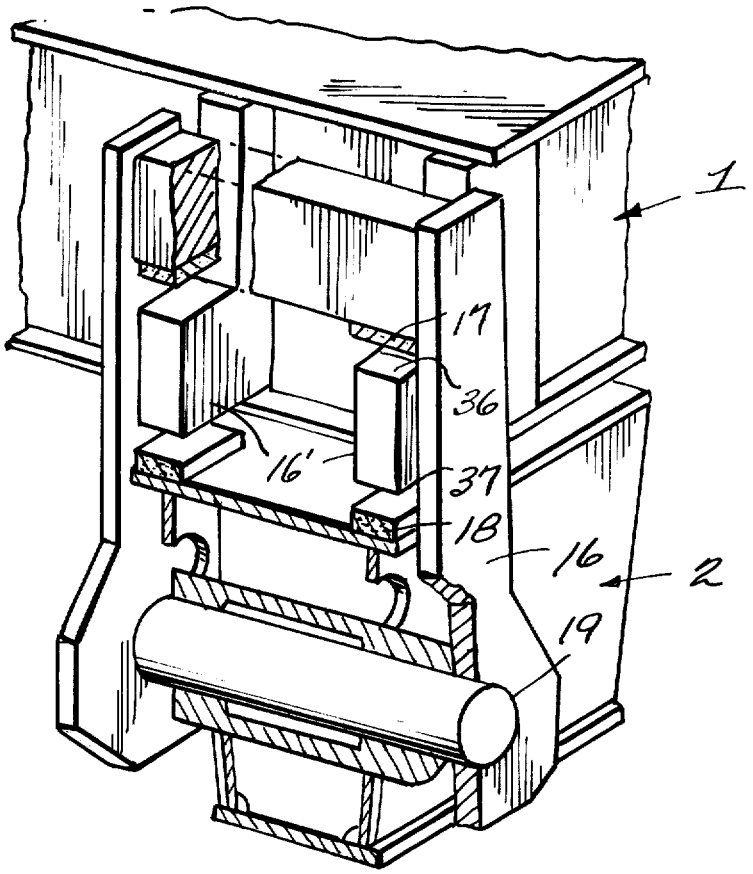
FIG. 2 is an enlarged fragmentary view, with parts broken away, showing some of the details of the lifting device shown in FIG. 1.

Tilting movement of the cross piece 2 around the pin 14' is limited by an inverted U-shaped bracket 16 (FIGS. 1 and 2) which extends over stop blocks 16' projecting from one side of the body 1 and has its depending arms connected by a pin 19 extending through the cross piece 2. The respective points of impact 36 and 37 between the bracket 16 and the piece 2 with the blocks 16' are cushioned by shock absorbers 17 and 18 of plastic deformable materials which may be installed on the blocks or on the bracket 16 and piece 2 as shown in FIG. 2.

The lifting device of the invention serves above all to receive and transport transportation flasks for fuel elements in a horizontal position or in specific sloping positions deviating from the horizontal. For this purpose, a crane double hook (not shown) is snugly fastened to the crane hook attachment structure 38. The curved metal links 6 are swingable upwardly about the pins 12 to insert the hook. When the hook is in place, the links 6 are lowered and locked in operative position by the locking pins 13.

The tilting of the cross piece 2 via pin 14' equalizes all tolerances and inexactitudes in the suspension and on the flask and makes possible a statically determined distribution of the load. When this cross piece 2 tilts around the bearing point or pin 14' to its limit, and strikes on the impact points 36 or 37 on the blocks 16', no damage occurs to the cross piece 2 or the torsion body 1, because of the plastic, deformable shock absorbers 17 and 18.

Before engaging the lifting device with the trunnions 24 of a flask 15, the swinging arms 9 of each pair are spread apart by rotation of the wheel 33 and, after the bearing holes 4' of the lug side arms 4 are aligned with the trunnions, are moved toward each other by opposite rotation of the wheel 33. By slight lifting of the device, the trunnions 24 are guided into the bearing holes in the lug side arms 4. Then the safety latches 23 (FIG. 3) are manually engaged and locked by pins (not shown), so that there can be no slipping out of the trunnions 24. The different lengths of, or the different distances between, the trunnions 24 of a flask 15 are compensated by corresponding skewing of the lug side arms via the swing bearings 11.

The construction of the lifting device of the invention also prevents a sudden fall of a flask by failure of one of the lug side arms 4. The construction of the torsion body 1 as well as the dimensioning of the lug side arms 4 also permit the holding of a transportation flask on two diagonally opposed lug side arms. Consequently there is a redundancy of structure which offers a substantial increase in safety compared to customary lifting devices.

Figure 7:
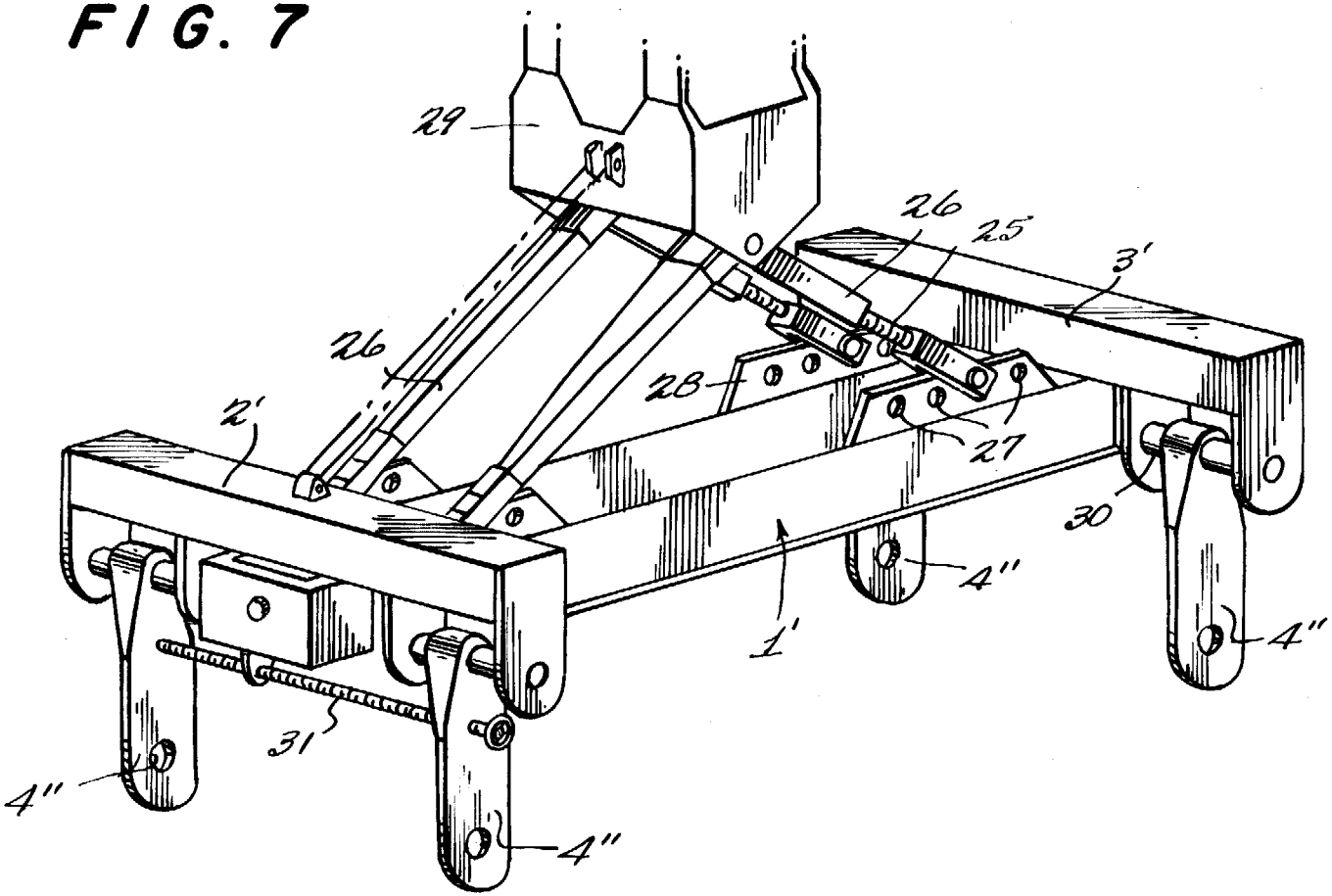
FIG. 7 is a schematic perspective view of another embodiment of a lifting device according to the invention.

A special variant of the lifting device of the invention is shown schematically in FIG. 7 with a torsion body or support 1'. Here a tilting cross piece 2' and a fixed cross piece 3' lie transverse to the axis of a flask in contrast to the parallel arrangement shown in FIG. 1. In this case, however, the fixed cross piece 3' is screwed together with the torsion body 1'; and therefore offers a further possibility of adjusting the spacing between pairs of the lug side arms 4'', (advantageous in case of extreme flask dimensions).

The control of the position of the centre of gravity of the combination lifting device and flask takes place by a coarse control, i.e. a pair of hoisting links 26 can be selectively secured in one of a row of openings 27 in upright supporting flanges 28 on the body 1 as well as a fine control, i.e. threaded spindles 25, for adjusting the length of those links.

The crane hook attachment structure 29 has a construction for the connection of the crane hook like that shown in FIG. 5. The control of the lateral spacing of a lug side arms 4'', is accomplished, however, by a jackscrew 31 which connects pairs of the arms 4'' and moves them along supporting rods 30.

This variant of the invention is preferably employed where space is not extremely restricted and permits handling therein before the secured region. Among other advantages, according to the invention, is the usability of the device for flasks which are excessively wide and excessively long.

The entire disclosure of German application No. P 2943523.2 is hereby incorporated by reference.

What is claimed is:

1. A lifting device for transporting flasks in a horizontal position, said flasks being provided at their ends with pairs of laterally projecting trunnions, particularly transportation flasks for radioactive materials in industrial nuclear plants, comprising:

a torsion body;

crane hook attachment structure on said body;

two cross pieces, one on each end of said body, one of said cross pieces being fixedly connected with said torsion body and the other being suspended from said body for tilting movement about a horizontal axis transverse of said other cross piece;

means for limiting such tilting movement relative to said body; and lug side arms detachably engageable with flask trunnions, one hanging from and mounted to each end of said cross pieces for lateral adjustment relative thereto.

2. A lifting device according to claim 1 in which each lug side arm is mounted to the corresponding cross piece for swinging movement around an upright pivot.

3. A lifting device according to claim 2 wherein the lug side arms are fastened to the cross pieces by swing bearings.

4. A lifting device according to claim 1 wherein the crane hook attachment structure comprises:

a pair of parallel rods on the body;

a pair of suspension plates on and slideable along each rod;

and curved links connecting the plates on each rod with the corresponding plates on the other rod.

5. A lifting device according to claim 4 including means for adjusting the position of the plates longitudinally along the rods.

6. A lifting device according to claim 5 wherein the plates of each pair are connected by adjustable-length spacer tubes.

7. A lifting device according to claim 1 wherein the means for limiting the tilting movement includes shock absorbers.

8. A lifting device according to claim 1 wherein the tilting connection of the other cross piece with the body includes a pin extending through an elongated slot.

9. A lifting device according to claim 1 wherein each cross piece includes on each end thereof arms mounted for lateral swinging movement with a lug side arm hanging from each of said arms, and including means for swinging the arms of each pair on corresponding ends of the cross pieces in opposite directions.

* * * * *